US006464022B1

(12) United States Patent
O'Brien et al.

(10) Patent No.: US 6,464,022 B1
(45) Date of Patent: Oct. 15, 2002

(54) MOBILE HORIZONTAL DIRECTIONAL BORING APPARATUS AND METHOD FOR USE IN BORING FROM EXISTING UTILITY MANHOLES

(75) Inventors: Gerard R. O'Brien, 210-46 Brook Village Rd., Nashua, NH (US) 03062; Gregory Moore, Weymouth; Harry Hutch, Marlboro, both of MA (US)

(73) Assignee: Gerard R. O'Brien, Nashua, NH (US)

( * ) Notice: Subject to any disclaimer, the term of this patent is extended or adjusted under 35 U.S.C. 154(b) by 0 days.

(21) Appl. No.: 09/624,879

(22) Filed: Jul. 24, 2000

(51) Int. Cl.[7] ..... E21B 7/08

(52) U.S. Cl. ..... 175/62; 175/19; 175/162; 175/73; 175/74; 175/75

(58) Field of Search ..... 175/61, 162, 19, 175/73, 74, 75, 62; 299/61, 34.12, 106

(56) References Cited

U.S. PATENT DOCUMENTS

| | | | | | |
|---|---|---|---|---|---|
| 3,326,008 | A | * | 6/1967 | Baran et al. | 175/19 |
| 3,398,804 | A | * | 8/1968 | Holbert | 175/61 |
| 4,029,428 | A | * | 6/1977 | Levens | 175/61 |
| 4,222,687 | A | | 9/1980 | Williams | 408/79 |
| 4,365,676 | A | | 12/1982 | Boyadjieff et al. | 175/61 |
| 4,691,788 | A | | 9/1987 | Yoshida et al. | 175/62 |
| 4,795,217 | A | * | 1/1989 | Hilaris | |
| 4,852,666 | A | * | 8/1989 | Brunet et al. | 166/117.5 |
| 4,998,590 | A | | 3/1991 | Wells | 175/162 |
| 5,022,471 | A | * | 6/1991 | Maurer et al. | |
| RE33,660 | E | * | 8/1991 | Jelsma | 175/107 |
| 5,085,283 | A | * | 2/1992 | Seabourn et al. | 138/133 |
| 5,103,920 | A | * | 4/1992 | Patton | |
| 5,119,889 | A | * | 6/1992 | Wiggs | 175/19 |
| 5,125,460 | A | | 6/1992 | Behrens | 173/184 |
| 5,197,783 | A | * | 3/1993 | Theimer et al. | |
| 5,419,405 | A | * | 5/1995 | Patton | |
| 5,425,429 | A | | 6/1995 | Thompson | 175/62 |
| 5,448,227 | A | * | 9/1995 | Orban et al. | |
| 5,452,967 | A | * | 9/1995 | Fuller | 138/97 |
| 5,540,292 | A | | 7/1996 | Behrens | 173/184 |
| 5,553,680 | A | | 9/1996 | Hathaway | 175/78 |
| 5,709,277 | A | * | 1/1998 | Geldner | |
| 5,720,354 | A | * | 2/1998 | Stump et al. | |
| 5,810,101 | A | | 9/1998 | Caraway, Jr. et al. | 175/78 |
| 5,873,421 | A | | 2/1999 | Assenza | 175/121 |
| 6,318,480 | B1 | * | 11/2001 | Hearn | 175/61 |

* cited by examiner

*Primary Examiner*—David Bagnell
*Assistant Examiner*—Katherine Mitchell
(74) *Attorney, Agent, or Firm*—Weingarten, Schurgin, Gagnebin & Lebovici LLP

(57) ABSTRACT

A mobile, horizontal directional boring apparatus and method is provided for boring from an existing utility manhole for the placement of small diameter fiber optic cabling. A mobile platform is located adjacent an existing utility manhole. A boring unit is rotatably and tiltably supported on the mobile platform, and a movable hollow arm assembly is provided from the boring unit to an opening in a wall within the manhole. A plurality of rods attachable end-to-end are operable under control of the boring unit to bore a pathway to the termination point. The rods are inserted through the hollow arm assembly from the boring unit to the opening in the manhole. In this way, the rods do not damage existing equipment within the manhole. A manhole containment unit is provided within the opening in the manhole wall to which the hollow arm assembly is attached and which further serves to protect the manhole. Also, a manhole rim protection device is provided to protect the rim and chimney of the manhole.

35 Claims, 14 Drawing Sheets

MOBILE HORIZONTAL DIRECTIONAL BORING APPARATUS AND METHOD FOR USE IN BORING FROM EXISTING UTILITY MANHOLES

CROSS REFERENCE TO RELATED APPLICATIONS N/A

STATEMENT REGARDING FEDERALLY SPONSORED RESEARCH OR DEVELOPMENT N/A

BACKGROUND OF THE INVENTION

The communications and cable television industries almost exclusively utilize fiber optic or coaxial cables. These cables are often laid underground beneath streets and sidewalks. Typically, backbone conduit systems are laid beneath streets, and lateral connections are taken off the backbone conduits to buildings or utility poles. The lateral connections in particular use cables having small diameters, usually less than one inch.

Backbone conduit systems are laid using a traditional open cut trench method or a large horizontal boring technique. In the open cut trench method, a trench is dug is the street and/or sidewalk along the conduit's route. The conduit is laid in the trench, and the trench is backfilled.

In the large horizontal boring technique, two large pits are dug. A large boring machine is lowered into the first pit, the sending pit, which then bores a pathway underground to the second pit, the receiving pit.

When a lateral is needed from an existing manhole in the backbone system, the open cut trench method is used almost exclusively. In this method, an open trench is cut in the street and/or sidewalk to a depth of two to three feet. A four-inch conduit is laid in the trench. The fiber optic cables are pulled through the conduit. The trench is then backfilled.

Since the breakup of the monopolistic telecommunications industry in 1984, many new entrants have begun to compete with the established telecommunication companies, the Regional Bell Operating Companies (RBOCs).

These new companies, Competitive Local Exchange Carriers (CLECs) may request the leasing of backbone conduits from the RBOCs, which under federal law the RBOCs must provide. The CLECs still have to get their facilities off of the RBOCs' backbone conduit network to buildings or pole lines in some manner. Even when the CLECs build their own backbone conduit system, they must provide lateral connections to buildings or poles.

Many cities and towns have adopted a lead company policy for telecommunication companies. This lead company policy provides that, if a company wants to dig the city or town streets, it must notify all potential telecommunication and cable TV companies of its intent, and ask them if they wish to participate in the "dig." This policy is intended to minimize the number of times that a street is dug. All interested parties share the costs proportionately. The lead company policy may have a negative effect on individual companies, however, in that it reveals to competitors where companies are building their networks. Additionally, once a city or town has newly repaved a street, it usually puts a five-year bond on that street and does not permit the street to be disturbed again, prohibiting cable TV and telecommunications companies from digging the street to provide their services.

The open cut trench method has other disadvantages as well. Excavation of streets and sidewalks results in the disruption of their original condition. Settlement is possible, creating a rut that may be a hazard to motor vehicles and pedestrians. The excavation may hit or damage an existing utility beneath the surface. In many instances, the work must be performed at night in urban locations due to motor vehicle congestion. Steel plating of all or partial lengths of the open trench must be provided to allow vehicular traffic to pass and pedestrian access for street crossing or building access.

Horizontal directional boring from within an existing utility manhole with working sensitive communication cables is presently not commercially available. The existing commercial large boring machines are not suitable for boring from within a manhole. Also, because existing manholes contain live, working cables, great caution must be exercised when any machinery is lowered into the manhole. This need for great caution discourages the placing of machinery or equipment into manholes.

SUMMARY OF THE INVENTION

The present invention relates to a mobile subterranean horizontal directional boring capability from within an existing utility manhole to buildings, to other manholes, and to utility poles, or from utility poles to manholes. The invention is particularly suitable for laying small diameter fiber optic cabling without the need for open cut trench excavation. The invention provides for protection of the manhole during the boring operation, so that existing equipment and facilities in the manhole are not damaged.

All of the machinery to provide the subterranean boring is mounted on a mobile vehicle that may be driven to the work site. The boring machinery includes a boring unit supported on the platform or bed of the vehicle. The boring machinery also includes an arm assembly, which may include an articulated arm or a flexible chute, through which boring rods are sequentially fed. The arm assembly leads from the boring unit to an opening within the manhole. The arm assembly is fastened to a containment unit provided within the opening in the manhole wall. In this manner, the integrity of the working CATV and telecommunications equipment and any other equipment present in the manhole is protected. A manhole rim protection unit is also provided around the manhole rim and secured to the manhole chimney.

The boring unit is operable up to at least a 60° tilt from level. In the preferred embodiment, it is sized to provide torque and thrust specifications to manage a two-inch bore for up to 400-foot distances. Rod flexibility specifications allow for a ten-foot radius. The boring unit and arm assembly are secured to a rotating turntable or lazy susan on the platform on the rear of the truck bed to allow pivoting of up 180°. Pivoting allows for truck work site positioning in congested areas to allow for the proper direction of the bore.

DESCRIPTION OF THE DRAWINGS

The invention will be more fully understood from the following detailed description taken in conjunction with the acompanying drawings in which.

DETAILED DESCRIPTION OF THE INVENTION

Figure 1:
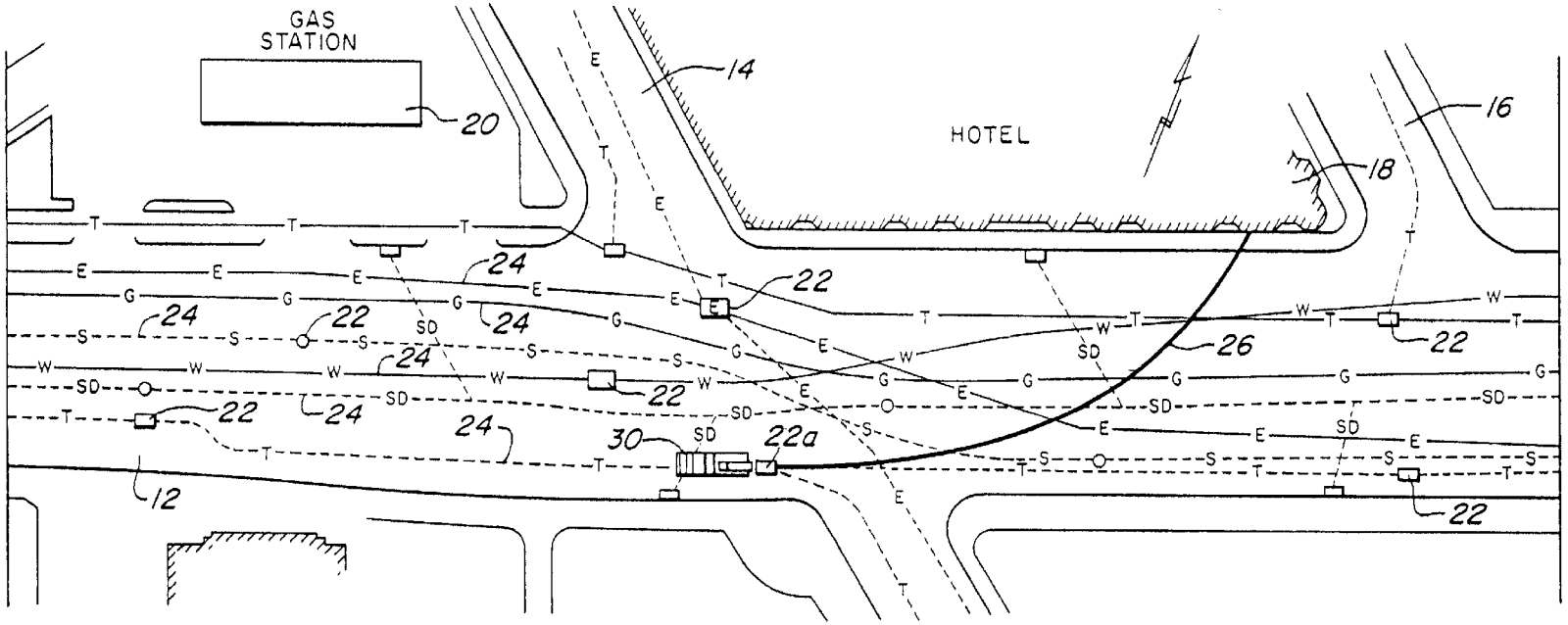
FIG. 1 is a plan view illustrating a bore from an existing utility manhole to a building.
Figure 2:
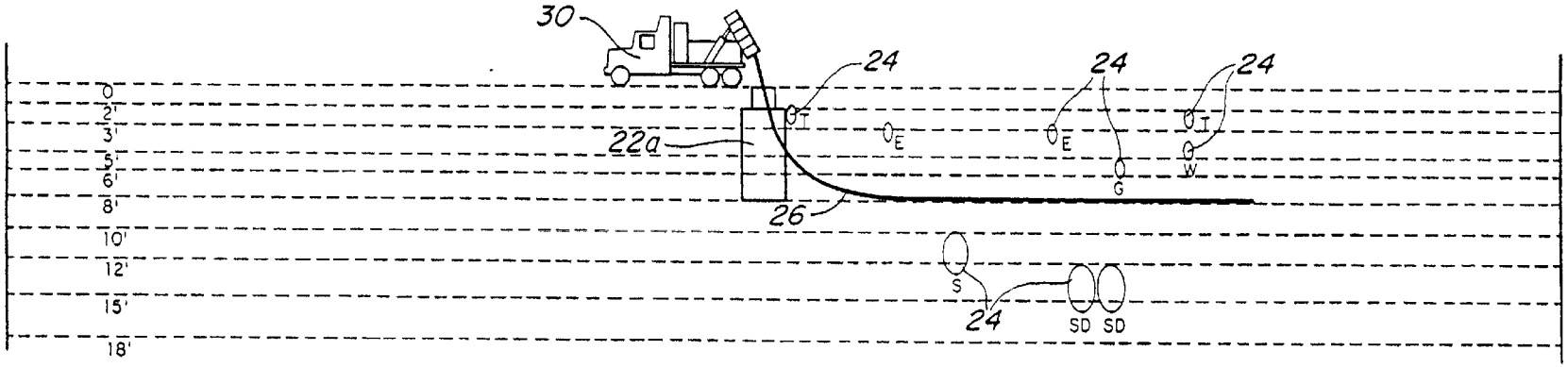
FIG. 2 is a cross-sectional view of the plan of FIG. 1.

The invention is shown generally in FIGS. 1 and 2. FIG. 1 is a plan showing several streets 12, 14, 16, and buildings, such as a hotel 18 and a gas station 20. The location of several manholes 22 and subterranean utility lines 24 are marked. The utility lines 24 include a telecommunications line ("T"), an electric line ("E"), a water line ("W"), a gas line ("G"), a sewer line ("S"), and a steam duct ("SD"). A vehicle 30 carrying the boring apparatus of the present invention is able to provide a new cable 26 from an existing manhole 22*a* along a telecommunications line to the hotel 18. It will be appreciated that the cable could be run from another manhole; the choice of manholes is determined by the particular situation. The selected manhole illustrates the ability of the boring apparatus to curve horizontally to reach the hotel and vertically to avoid the existing underground lines. As best indicated in FIG. 2, the bore dips below the existing telecommunications, electric, gas, and water lines and above the existing sewer line and steam duct.

Figure 3:
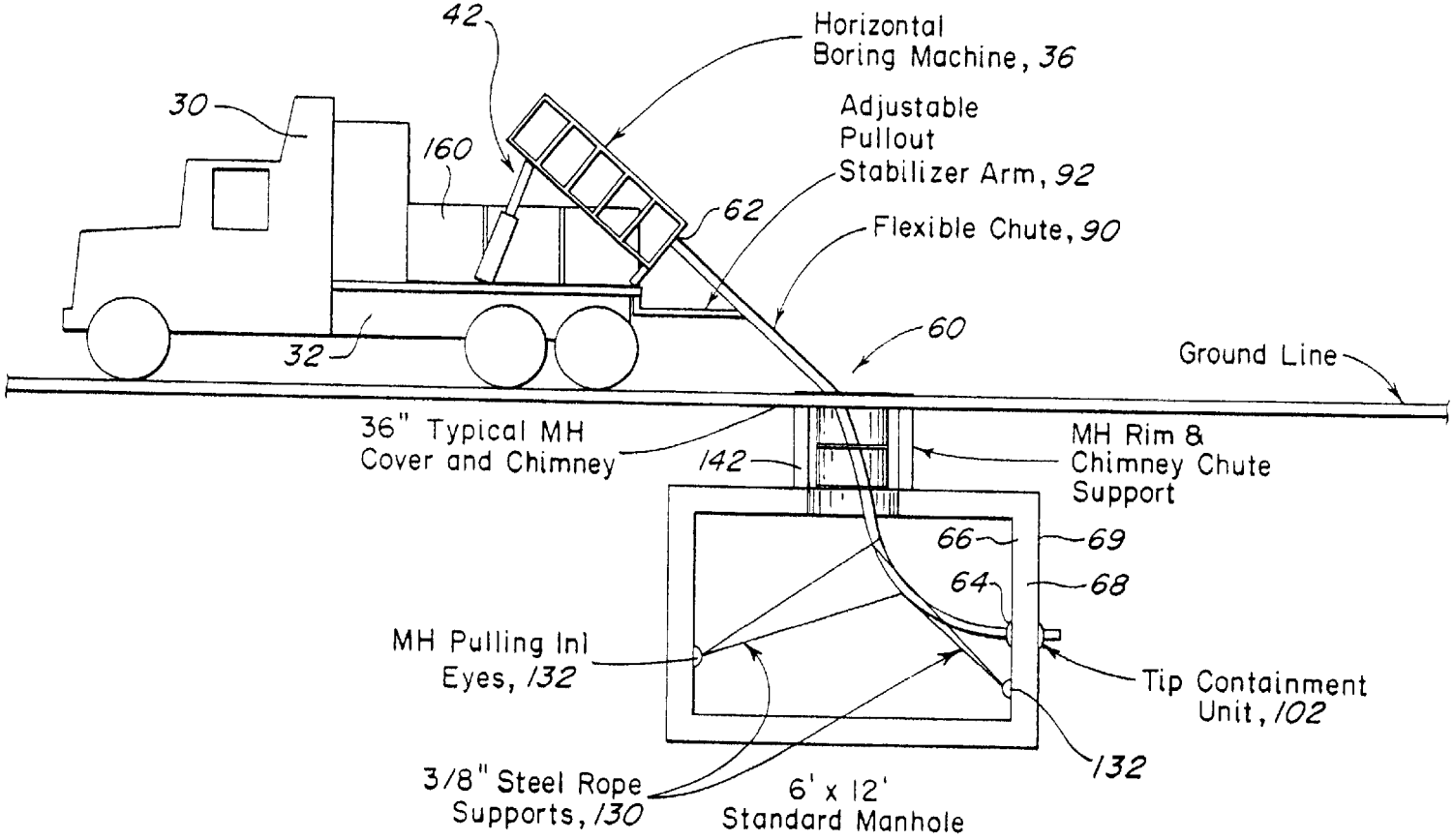
FIG. 3 is a schematic side view of a boring apparatus according to the present invention.
Figure 4:
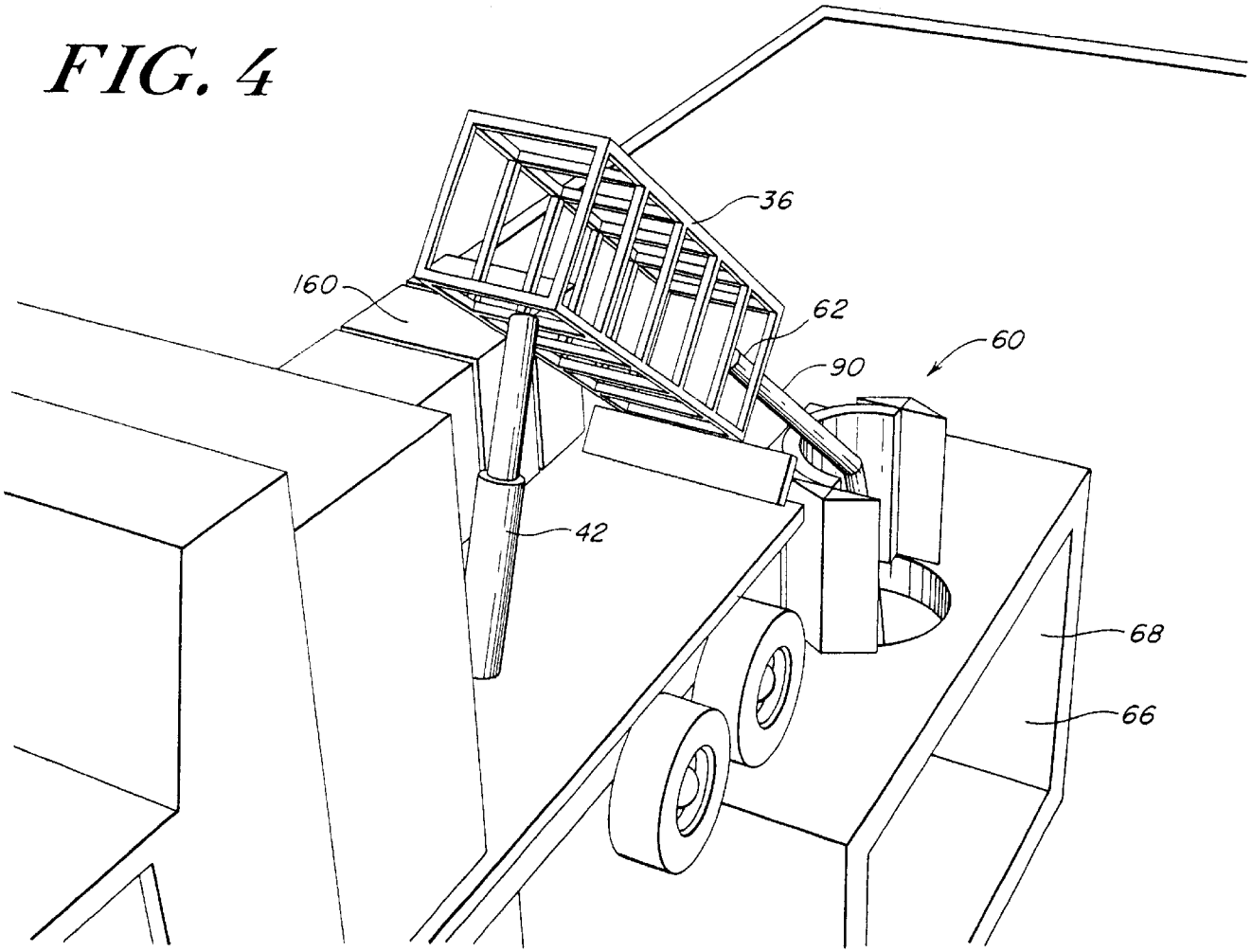
FIG. 4 is an isometric view of a further embodiment using a flexible chute according to the present invention.
Figure 5:
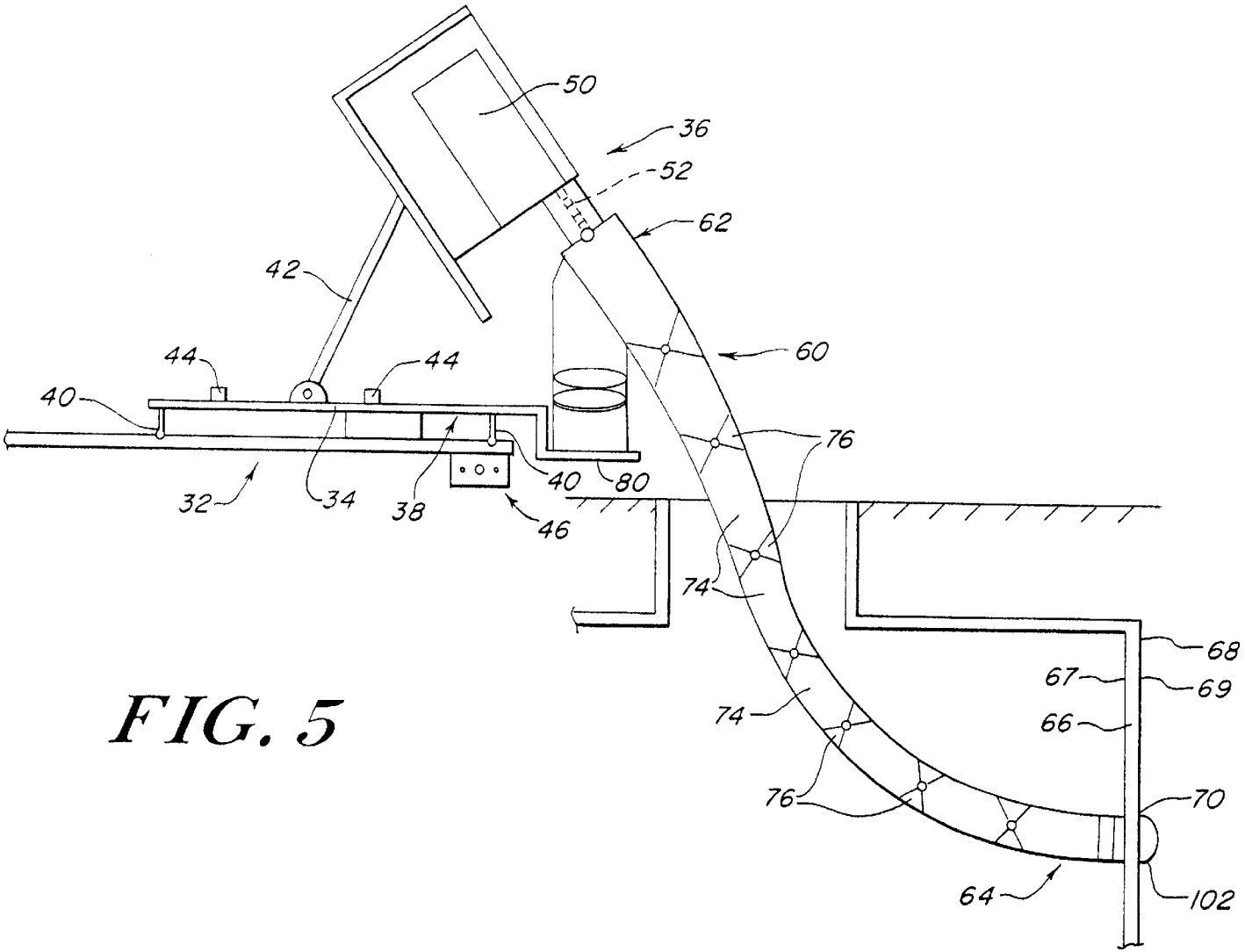
FIG. 5 is a schematic view of a first embodiment using an articulated arm according the present invention.

Referring more particularly to FIGS. 3 through 5, the apparatus of the present invention includes the vehicle 30, such as a truck, having a platform 32, which may be the bed of the truck. Stabilizers, such as extensible hydraulic leg stabilizers (not shown), are provided on the sides of the vehicle for stabilizing and leveling the platform at the work site. A turntable or lazy susan 34 is supported by the platform 32. (See FIG. 5; for clarity the turntable is not shown in FIGS. 3 and 4.) Boring machinery 36 is supported on the turntable 34 for rotation, preferably about 180°. In this way, the boring machinery can be rotated to face in a desired direction, which is particularly helpful when the work site is located in a congested area in which positioning of the vehicle may be limited. The turntable is preferably a strong steel plate 38 mounted for rotation about a central axis. Support wheels 40 are provided at several locations underneath the plate to assist in bearing the load of the boring machinery and in easing rotation of the turntable over the platform 32. The end of the platform ay also be rounded so as not to protrude into the work area.

A tilting mechanism 42 is supported on the turntable 34 and is operable to tilt the boring machinery 36 to a desired angle, which can provide the boring machinery with better access to the manhole. In a preferred embodiment, the tilting mechanism comprises a hydraulic lift mounted on the turntable and attached to an underside of the boring machinery framework. The boring machinery is also preferably pivotally fixed to the turntable near the end of the vehicle's platform (FIGS. 3 and 4; for clarity, not shown in FIG. 5). Feet or rests 44 may be provided on the turntable to support the boring machinery in the lowered position (FIG. 5). By extending the hydraulic lift, the boring machinery is tilted upwardly away from horizontal. Preferably, the tilting mechanism is operable to tilt the boring machinery at least 60° from horizontal. Controls 46 for the turntable and tilting mechanism are provided in any suitable operator accessible location, such as on a side of the platform. The controls may also be provided on a detachable hand control panel in communication with the turntable and tilting mechanism via suitable cabling.

Figure 6:
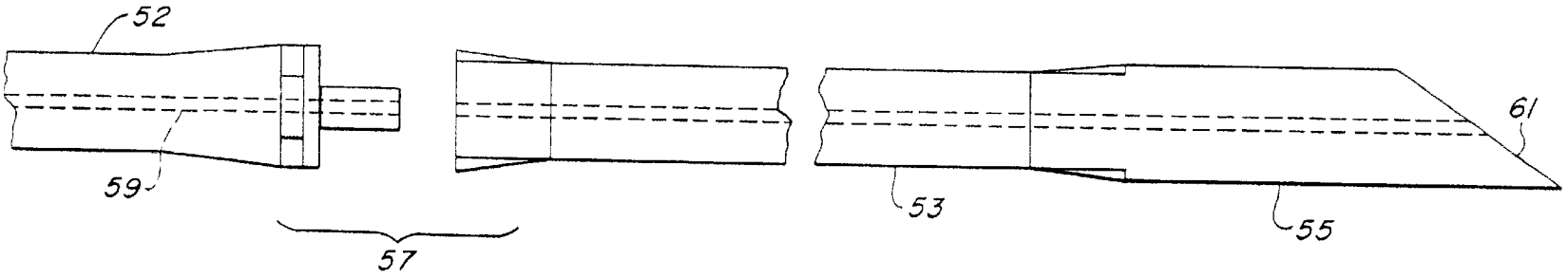
FIG. 6 is a schematic illustration of interconnectable boring rods.

The boring machinery 36 includes a directional boring unit 50 having a plurality of rods 52 and a suitable power source or motor for driving the rods, as would be known in the art. The boring unit is capable of both rotating the rods, for cutting, and pushing the rods without rotation, for changing direction. Referring to FIG. 6, a lead rod 53 includes a cutter head 55, and subsequent rods 52 attach end to end to extend the length of the bore to the termination point. The rods may be joined end to end in any suitable manner, such as by a threaded coupling 57. An axial channel 59 through the center of the rods is provided to allow passage of a jet of high pressure water. The cutter head 55 includes a sonic unit to allow detection of the cutter head's orientation and location from a remote detection unit. The detection unit is preferably hand-held and carried by the operator at street level. The cutter head includes an angled cutting face 61 to allow for directional movement upon pushing of the cutter head, as is known in the art.

The boring unit 50 is sized to provide the needed torque and thrust to provide a two-inch diameter bore for up to 400 feet. A two-inch diameter bore is able to receive a 1-¼-inch diameter inner duct through which a one-inch fiber optic cable may be laid, which is suitable for telecommunications and cable TV cabling. The boring unit is also directionally operable to bore a pathway having vertical and horizontal curvatures, as would be known in the art. To maneuver into the manhole and between existing subterranean utility lines, the rods are preferably capable of bending horizontally and vertically along curves having a radius of ten feet. A drilling fluid or water reservoir (not shown) may be provided.

Optionally, a rod loader (not shown) may be used. Controls 46 for the boring unit are provided, for example, on the side of the vehicle in an operator accessible location or on a detachable hand held control panel, for controlling the boring machinery.

The boring machinery 36 also includes a hollow, movable arm assembly 60 that is fixed at one end 62 near or to the boring unit 50. Another end 64 of the arm assembly is firmly attached to an interior wall 66 of the manhole 68 adjacent an opening 70 previously cored in the wall of manhole. During a boring operation, the rods 52 are loaded through the interior of the hollow arm 60. In this manner, the rods do not touch or otherwise damage the manhole or any of the existing equipment in the manhole.

In one preferred embodiment (see FIGS. 3 and 4), the arm assembly comprises a flexible chute 90 that can also be positioned as desired. The flexible chute is formed, for example, of metal and preferably is an extensible and retractable corrugated structure that retains its shape. The chute must be sufficiently stiff to generally retain its shape after positioning and to support the rod sections therein. The chute may be provided in sections to form different lengths. An adjustable pull out stabilizer arm 92 may be provided on the turntable plate 38 to support the chute.

Figure 7:
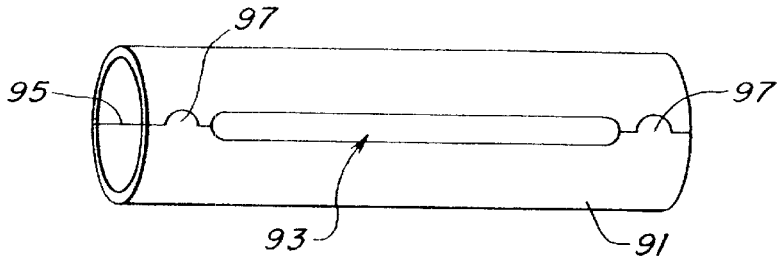
FIG. 7 is a schematic illustration of a boring rod access chute.

A rod access chute 91 is provided at the end 62 of the flexible chute that is connected to the boring unit. See FIG. 7. The rod access chute is a stiff tube with an elongated window 93 therein to allow viewing of the rods during a boring operation. The tube is hinged along one side 95 and is lockable with a locking mechanism 97 along the other side. In this way, the access chute may be opened by. unlocking the locking mechanism and lifting one-half of the tube about the hinge to allow the coupling of another rod 52 back to the boring unit 50 when necessary.

Figure 8:
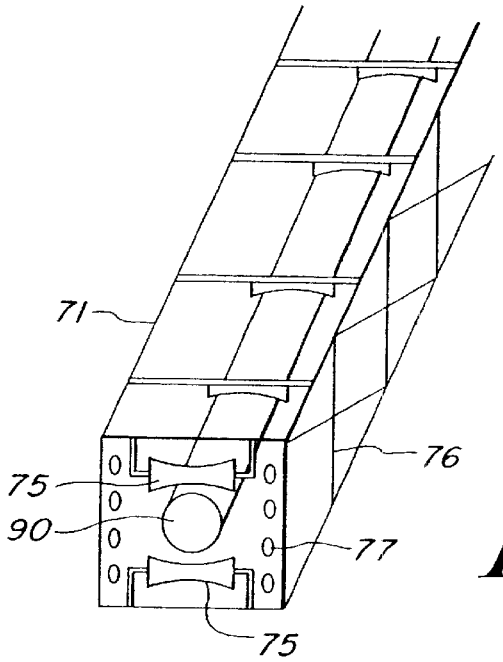
FIG. 8 is an isometric schematic view of an articulated arm according to the present invention.
Figure 9:
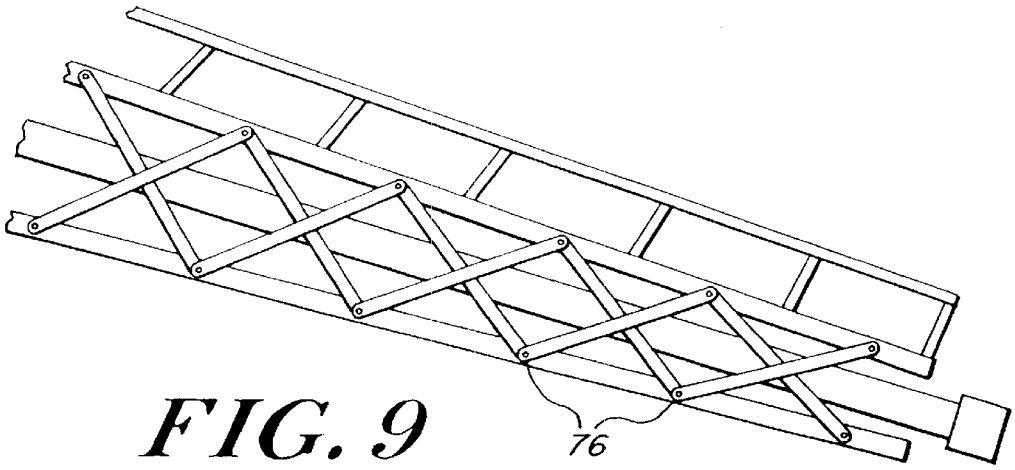
FIG. 9 is a side view of the articulating arm of FIG. 8.
Figure 10:
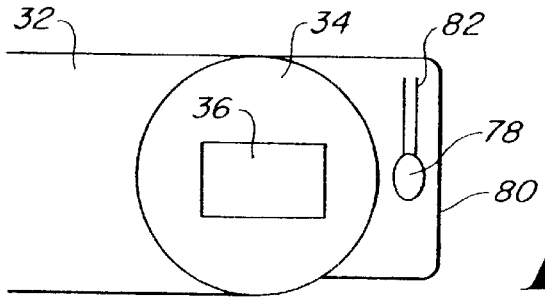
FIG. 10 is a partial plan view of the embodiment of FIG. 5 illustrating a storage capability of the articulating arm.

In another preferred embodiment, indicated in FIGS. 5, 8, and 9, the arm assembly includes an articulating arm 71 comprising frame sections 74 formed of a plurality of flexible joints or scissors joints 76. The frame supports a flexible chute, such as the flexible chute 90 described above. The scissors joints, which for clarity are indicated only schematically in FIGS. 5, 8, and 9, allow the frame sections to be moved or positioned as appropriate to extend from the boring unit 50 on the vehicle into the manhole and to the opening in the manhole side, as would be understood by those of skill in the art. The articulating arm must be sufficiently stiff to generally retain its shape after positioning and to support the rod sections therein. The frame sections are attached to each other as needed to form the appropriate length between the boring unit and the core in the manhole. Within the frame sections, rollers 75 are provided to support the flexible chute. Preferably, upper and lower rollers are provided. Hydraulic lines 77 for supplying hydraulic fluid to the joints and any other components may be supported within the arm.

Figure 11:
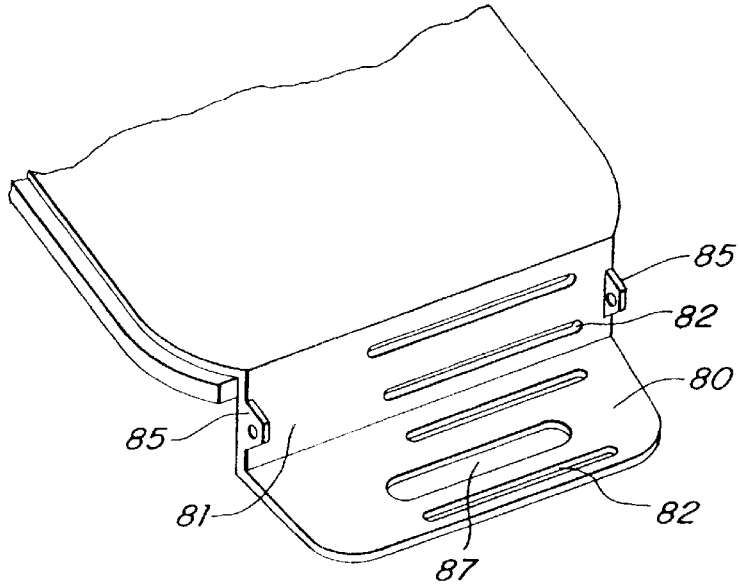
FIG. 11 is a partial isometric view of an end of the vehicle platform.
Figure 12:
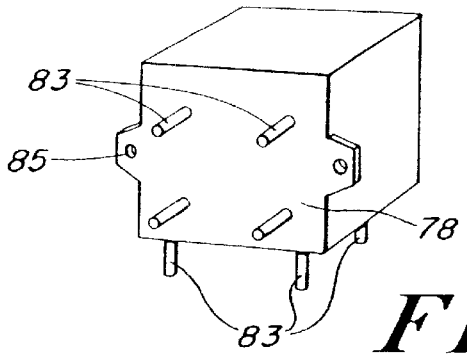
FIG. 12 is a schematic illustration of a base for supporting the articulating arm of FIG. 8.
Figures 13, 14:
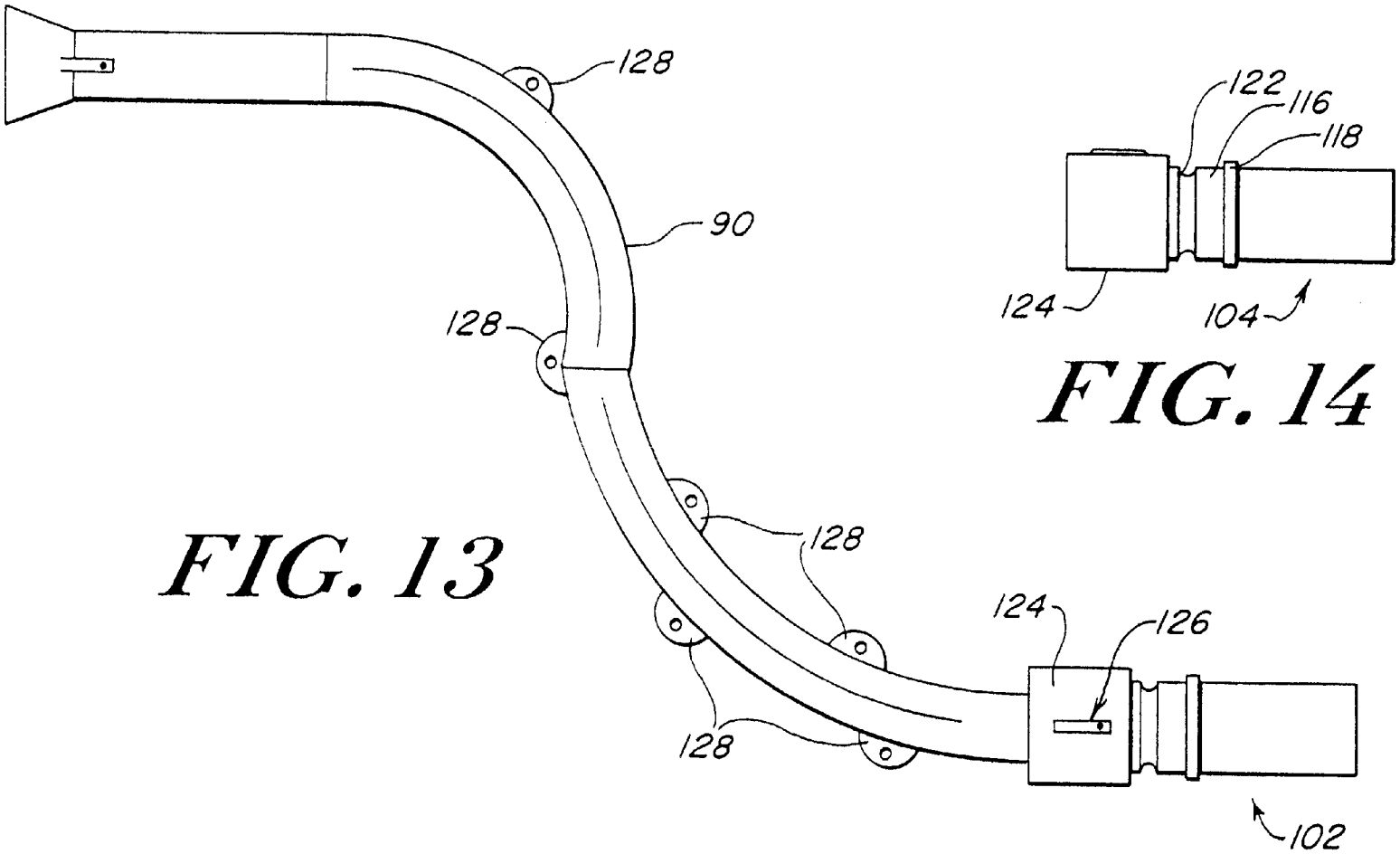
FIG. 13 is a schematic side view of the flexible chute of FIGS. 3 and 4.
FIG. 14 is a schematic side view of a containment unit according to the present invention.
Figure 15:
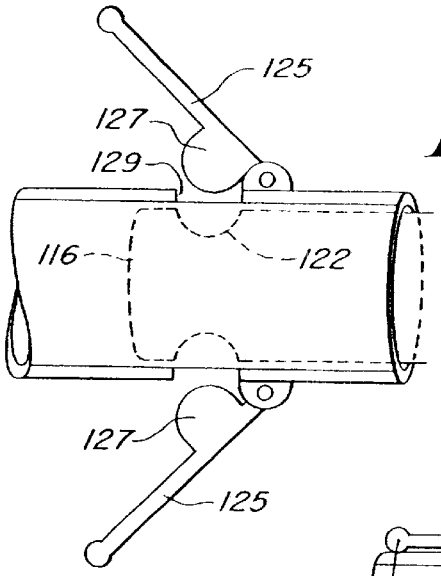
FIG. 15 is a schematic side view of a coupling for use with the containment unit in an open position.
Figure 16:
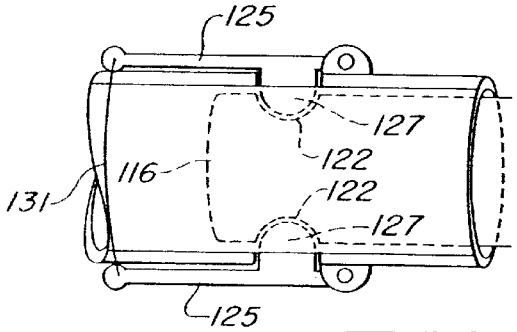
FIG. 16 is a schematic side view of the coupling of FIG. 15 in a closed position.
Figure 17:
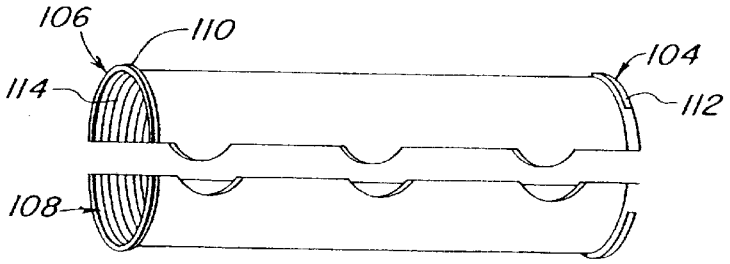
FIG. 17 is a schematic isometric view of a shell of the containment unit of FIG. 14.
Figure 18:
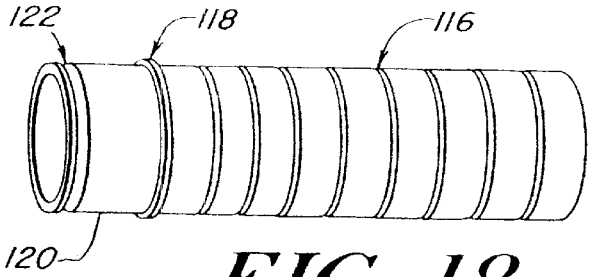
FIG. 18 is a schematic isometric view of a pipe of the containment unit of FIG. 14.
Figure 19:
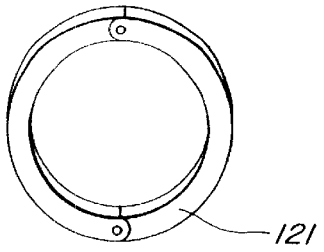
FIG. 19 is an isometric view of a spacer for use with the containment unit of FIG. 14.

The articulated arm 71 is preferably supported on a boom or base 78 or other support structure that rests on a shelf 80. See FIGS. 5 and 10–12. The shelf may be integrally formed with or attached to the turntable plate 38. The base may be mounted for movement along slide channels or slots 82 on the shelf 80 and the vertical shelf wall 81, so that the base and the arm may be moved out of the way when not in use during a boring operation. Fastening mechanisms 83 such as threaded bolts and lock downs on the base fit through the slots. The lock downs are tightened on the bolts to fasten the base to the shelf and loosened to slidably move the base along the shelf. Additional lugs 85 may be provided on the base and shelf to further fasten the base to the shelf. A channel 87 may be provided for passage of hydraulic or other cabling. For clarity, the boom or base 78 is not illustrated in FIG. 11.

A manhole containment unit 102 (FIGS. 3, 5, and 13–19) is provided within the manhole 68 for protection at the opening 70 through the manhole wall 66. The manhole containment unit 102 is inserted through the opening in the wall and provides a secure pathway and attachment mechanism for the movable arm assembly of the boring machinery. The containment unit reduces or eliminates movement of the arm assembly in the sensitive environment within the manhole.

The containment unit includes an outer cylindrical shell 104 (FIG. 17), such as of steel, which may be provided in two halves 106, 108 to fit through the opening 70 cored in the wall. Typically, the core is three inches in diameter and the shell outer diameter is 2-15/16 inches when joined. Interior and exterior lips 110, 112 are provided on the ends of the shell. The interior 114 of the shell is threaded. An exteriorly threaded pipe 116 screws into the shell to the position of a stop plate 118, typically a length of about nine inches. The pipe forces the shell into contact with the opening 70. The lip 112 abuts against the outer surface 69 of the manhole. A portion of the pipe, about three inches, the tip end 120, may protrude into the interior of the manhole. A spacer 121 (FIG. 19) may be provided between the interior surface 67 of the manhole and the lip 110 if necessary to prevent the containment unit from moving.

The chute 90 fits over the tip end of the pipe and locks thereto in any suitable manner. For example, referring to FIGS. 14–16, an annular depression 122 is formed about the circumference of the tip end 120. The movable arm includes a locking member 124 with hinged levers 125 on the leading end that slides over the tip end 120 of the containment unit pipe 116. In a closed position, detents 127 on the levers fit into the annular depression 122 through openings 129 in the locking member. The levers are further fastened in a closed position with a tie wrap 131. The arm assembly also includes fixtures such as eyes 128 at several locations to which stabilizing cabling 130, such as 3/8-inch steel rope, may be fastened (see FIG. 3). An opposite end of the stabilizing cabling is fastened to existing support fixtures 132, such as tie-offs or eyes, within the manhole. This stabilizing cabling further assists in maintaining the arm assembly away from sensitive equipment in the manhole.

Figure 20:
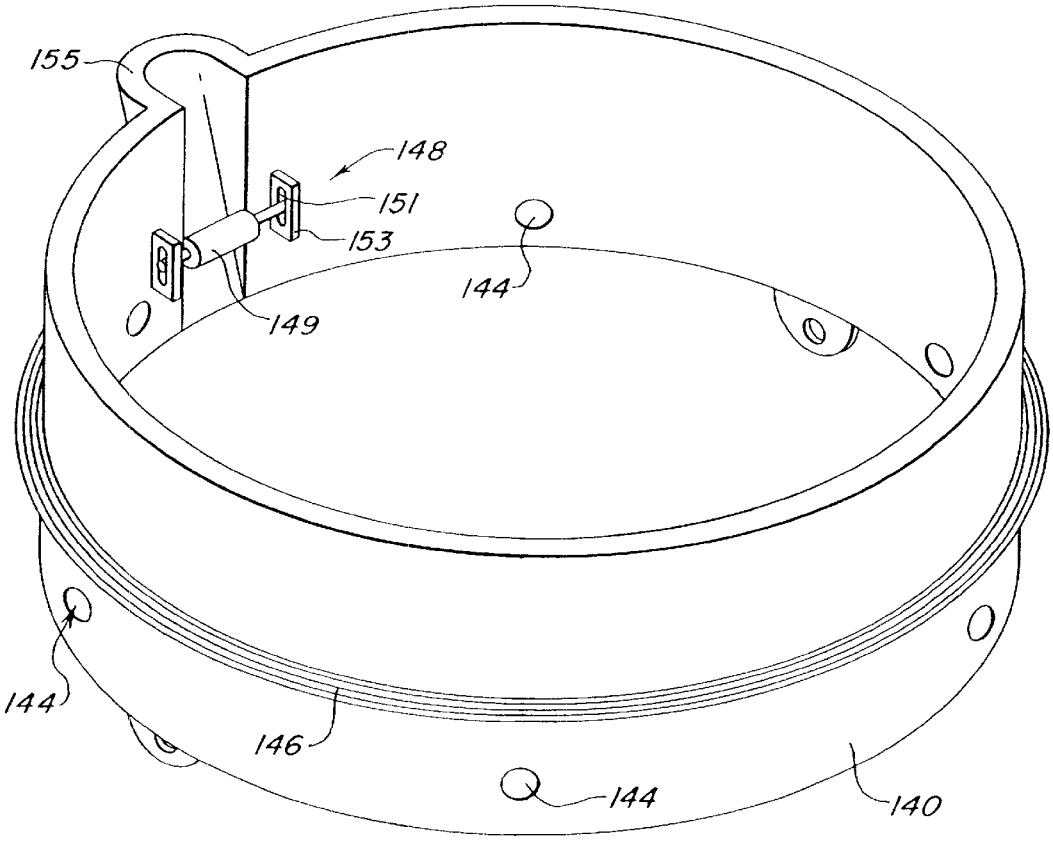
FIG. 20 is an isometric view of a manhole rim protection unit according to the present invention.
Figure 21:
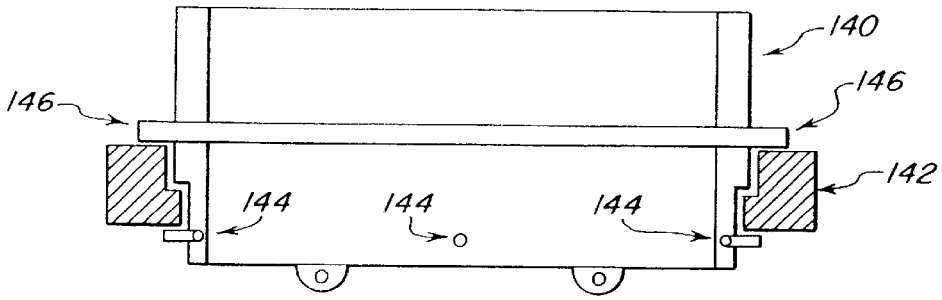
FIG. 21 is a cross-sectional view of the manhole rim protection unit of FIG. 20 on a manhole.

The apparatus also includes a manhole rim protection unit 140 (FIGS. 20–21). The manhole rim protection unit comprises a cylindrical member that rests inside the manhole chimney 142 and protrudes above the manhole rim. The protection unit provides a buffer between the movable arm and the manhole. The protection unit is a cylindrical member, typically 36 inches in outer diameter to fit within most manhole openings. Other sizes may be provided to fit other standard manhole sizes. Any suitable attachment mechanism is provided to attach the protection unit to the manhole. For example, set screws 144 may be provided around the periphery to secure the unit against the chimney wall below the manhole lip. A gasket member 146, such as a flexible rubber rim, which may be inflatable, is provided, generally around the midpoint of the unit to rest against the manhole rim. The gasket member assists in preventing surface water from entering the manhole between the unit and the chimney and traveling down into the manhole.

Figure 22:
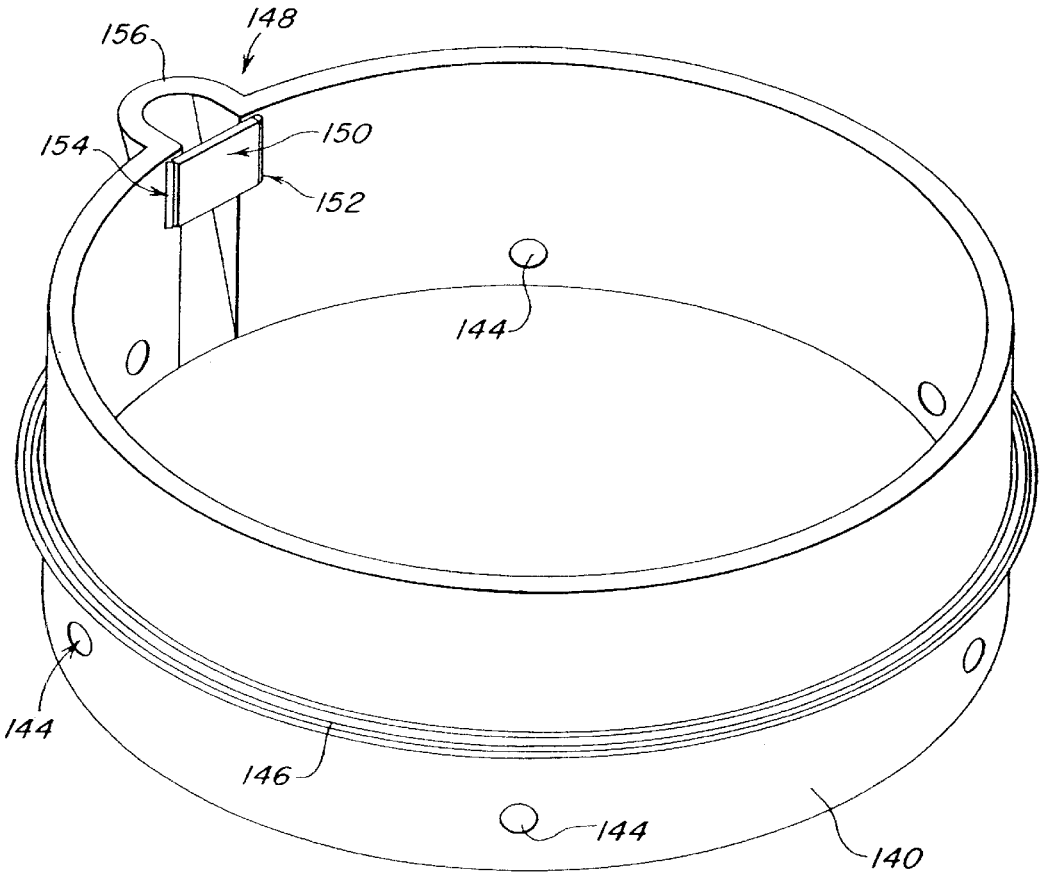
FIG. 22 is an isometric view of a further embodiment of a manhole rim protection unit according to the present invention.

The protection unit also may include a fixture 148 to which the movable arm may be attached. For example, an adjustable roller 149 may be mounted in slots 151 provided on ears 153 attached to an interior surface of the protection unit. A wall portion 155 of the unit extends outwardly adjacent the roller forming a recess to allow tying of the arm to the roller. In another embodiment, FIG. 22, a latch 150 may be fixed with a hinge 152 to an interior surface of the protection unit. The latch may be locked against the surface with a lock pin 154 that fits through a loop or ring on the surface. When the latch is locked closed against the interior surface with the lock pin, a recess is provided to which the arm may be tied.

The vehicle 30 includes storage areas 160 for the containment unit and the manhole rim protection unit as well as for various other small tools and hardware, such as a subterranean utility locator meter, a manhole foreign gas indicator meter, and two-way radios. Other necessary components such as a compressor and a generator are provided on the platform. The storage areas and other components may be located in any suitable place on the platform, such as along one side. Similarly, one or more water tanks are mounted on the platform, as are a manhole water extraction pump, a manhole air ventilator blower, rod storage, and flood lighting for night work.

In operation, the vertical and horizontal profile of all subterranean utilities and structures along the path of the proposed bore is determined. This profile can be determined in any known manner, such as with a utility location measuring meter and utility location records. The location and depth of all such utilities and structures are indicated on the ground with, for example, chalk. Any necessary governmental approvals are obtained.

The mobile boring truck is driven to the manhole work site and the work area protection is set up. The truck is positioned over the manhole. In the case of the articulating arm, the arm assembly is moved from its storage position. The lazy susan is rotated to the proper position to minimize both distance and angle to enter the manhole. The side stabilizers are set in place. The proposed bore route is outlined, for example, in chalk, on the street and/or sidewalk. Any water in the manhole is pumped out, and the manhole is tested for foreign gas and ventilated.

A three-inch diameter hole is cored out of the side of the manhole. A three-inch diameter hole is similarly cored out of the basement of the receiving building, if the bore is going to a building. The depth and location of the receiving cored building hole is indicated on the outside of the building.

The manhole wall containment unit and manhole rim protection unit are installed. In the case of the articulating arm, the boom is moved into position and the arm is mechanically lowered into the manhole. The arm assembly is attached to the manhole wall containment unit. In the case of the flexible chute, the proper length chute is attached to both the boring machine and the manhole wall containment unit and stabilized at the manhole rim protection unit. The chute is also fixed to or supported on the pull out stabilizer arm. Stabilizing cabling, such as ⅜-inch steel rope, is attached between the arm and preexisting support fixtures, such as tie-offs or eyes, within the manhole.

The boring machine is then hydraulically elevated to the proper angle and the required connections are made along with rod assembly and insertion down the arm assembly. The horizontal directional bore commences. An operator at the vehicle controls the boring machine. A ecrewmember operates a bore sonic locating meter to transmit the exact location and depth of the bore's progress to the machine operator.

Once the bore is complete, the end sonic locating unit is removed, and an appropriate inner duct, such as Schedule # 40 1-¼ inch inner duct, is placed in the bore. Typically, the duct is attached to the lead rod at the building and back pulled from the building into the manhole, providing the pathway for installation of the desired cabling. Once the inner duct has been installed, the core holes around the manhole and the building inner duct are dressed off and sealed with high pressure concrete and the inner duct is plugged at both ends to prevent water from entering. The duct is now ready for installation of a fiber optic or coaxial cable by a communications company. The machinery is broken down and is available to move to the next work site.

Figure 23:
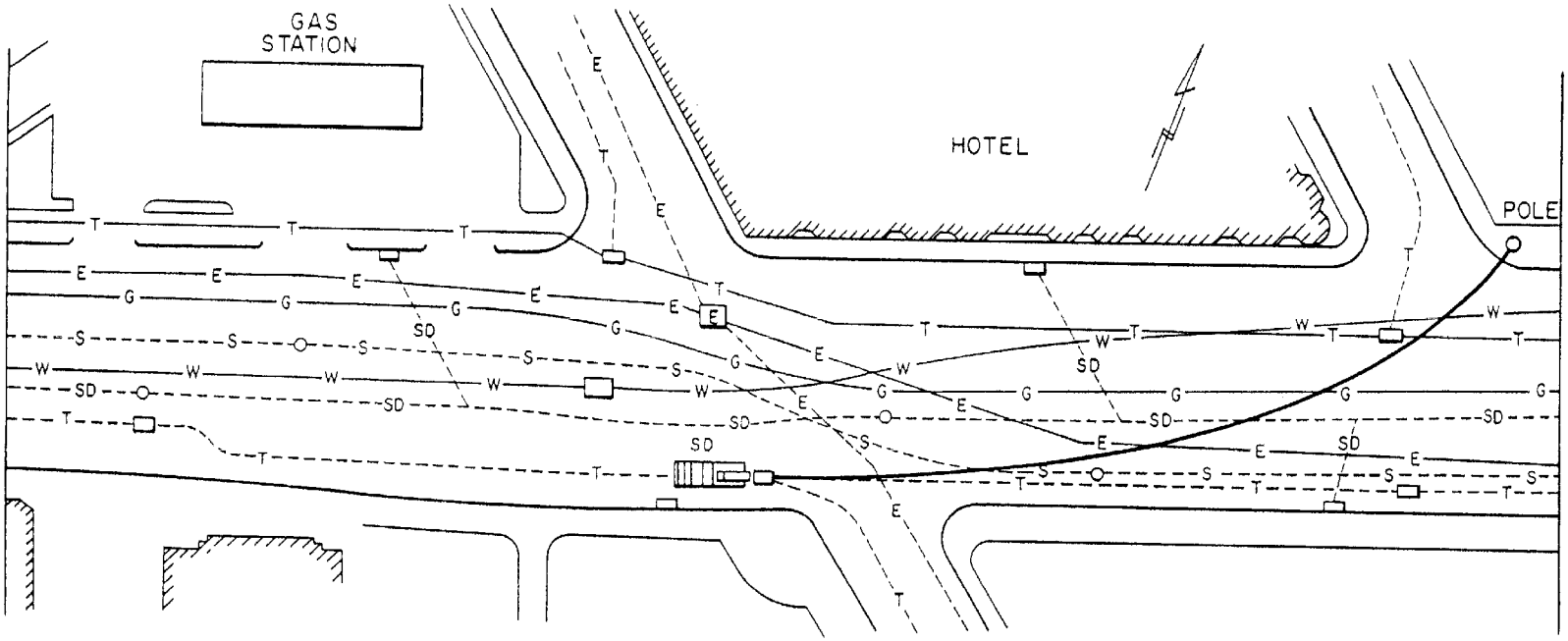
FIG. 23 is a plan view illustrating a bore from an existing utility manhole to a utility pole.
Figure 24:
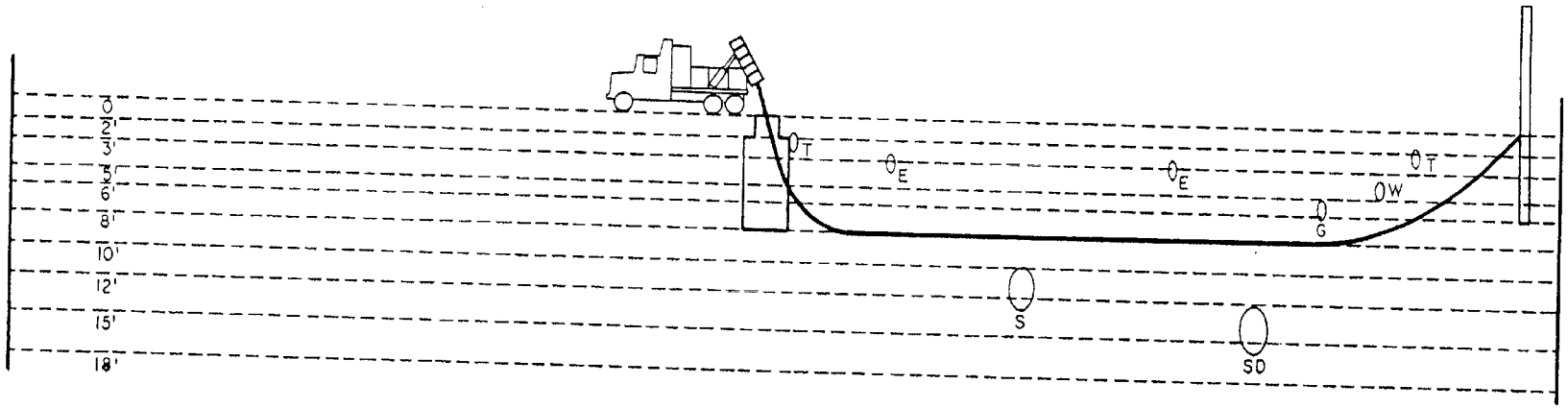
FIG. 24 is a cross-sectional view of the plan of FIG. 12.

FIG. 23 illustrates a plan showing several streets and buildings and a utility pole. A bore is run from the boring apparatus to the utility pole. As seen in FIG. 24, the bore dips below existing telephone, electric, gas, and water lines and above existing sewer lines and steam ducts. The bore terminates at the utility pole. An approximate 2'×2'×2' volume of soil around the base of the pole is removed. A 90° radius, two-inch diameter galvanized sweep pipe in installed in the resulting hole to receive the inner duct. In other respects, the invention is similar to that described above. It will also be appreciated that the bore may be run from one manhole to another manhole, which is treated similarly to a bore run to a building, as discussed above.

The invention is not to be limited by what has been particularly shown and described, except as indicated by the appended claims.

What is claimed is:

1. A mobile, horizontal directional boring apparatus connectable to an existing utility manhole for boring from the existing utility manhole, the apparatus comprising:

a mobile platform locatable on a ground surface adjacent the existing utility manhole; and boring machinery comprising:

a boring unit positionably supported on the mobile platform, a plurality of rods attachable end-to-end and operable under control of the boring unit to bore a pathway having a diameter and a vertical curvature and a horizontal curvature, the diameter including a diameter of two inches, and the horizontal curvature and the vertical curvature each including a curvature having a radius of ten feet, and a movable hollow arm assembly, the arm assembly having an internal diameter sufficient to receive the plurality of rods attached end-to-end, the arm assembly having a first end supported at the boring unit and located to sequentially receive the rods inserted therethrough, and the arm assembly having a second end connectable to an opening in a wall of a manhole to direct the rods through the opening.

2. The apparatus of claim 1, wherein the movable arm assembly comprises an articulating arm having a plurality of flexible joints.

3. The apparatus of claim 2, wherein the articulating arm is mounted on a boom supported on the platform.

4. The apparatus of claim 3, wherein the boom is movably mounted on the platform for movement to and from a storage position.

5. The apparatus of claim 1, wherein the movable arm assembly comprises a flexible chute.

6. The apparatus of claim 5, further comprising a stabilizer arm on the platform locatable to support the flexible chute.

7. The apparatus of claim 1, further comprising a turntable supported by the platform, the boring unit supported for rotation about a vertical axis on the turntable.

8. The apparatus of claim 7, wherein the turntable is operable to rotate the boring machinery through 180°.

9. The apparatus of claim 1 further comprising a tilting mechanism supported by the platform, the boring unit supported for tilting about a horizontal axis by the tilting mechanism.

10. The apparatus of claim 9, wherein the tilting mechanism is operable to tilt the boring machinery to an angle of at least 60° from horizontal.

11. The apparatus of claim 1, wherein the rods are attachable end-to-end to a length of at least 400 feet.

12. The apparatus of claim 1, further comprising stabilizing cabling having a first end attachable to the movable hollow arm assembly and a second end attachable to a support inside the manhole.

13. The apparatus of claim 1, further comprising a manhole rim protection unit attachable to a rim and chimney of the manhole.

14. The apparatus of claim 13, wherein the movable hollow arm assembly is attachable to the manhole rim protection unit.

15. The apparatus of claim 13, wherein the manhole rim protection unit further includes a gasket sealing member between an outer surface of the manhole rim protection unit and the rim of the manhole.

16. The apparatus of claim 1, further comprising a manhole containment unit mountable within the opening in the wall of the manhole, the second end of the movable hollow arm attachable to the manhole containment unit.

17. The apparatus of claim 16, wherein the manhole containment unit comprises an outer cylindrical shell and an inner pipe threadably received in the outer cylindrical shell, a portion of the inner pipe protrudable into the interior of the manhole, a locking mechanism for attachment to the second end of the movable hollow arm provided on the rotrudable portion.

18. The apparatus of claim 17, wherein the locking mechanism includes a detent on the second end of the movable hollow arm assembly and a depression on the protrudable portion.

19. The apparatus of claim 1, wherein the mobile platform comprises a vehicle.

20. A method of horizontally directionally boring from an existing utility manhole to a termination point, the method comprising:

determining a horizontal and vertical profile for a bore pathway from a manhole to the termination point that avoids existing subterranean utility lines;

providing a mobile platform and boring machinery, the boring machinery comprising:

a boring unit positionably supported on the mobile platform, a plurality of rods attachable end-to-end and operable under control of the boring unit to bore a pathway having a diameter and a vertical curvature and a horizontal curvature, the diameter including a diameter of two inches, and the horizontal curvature and the vertical curvature each including a curvature having a radius of ten feet, and a movable hollow arm assembly, the arm assembly having an internal diameter sufficient to receive the plurality of rods attached end-to-end, the arm assembly having a first end supported at the boring unit and located to sequentially receive the rods inserted therethrough, and the arm assembly having a second end connectable to an opening in a wall of a manhole to direct the rods through the opening; positioning the boring unit adjacent a manhole; coring a hole in an interior sidewall of the manhole; positioning the movable hollow arm assembly with the first end adjacent the boring unit and the second end connected to the opening in the wall of the manhole; sequentially feeding the rods through the arm assembly and the opening in the manhole;

boring to the termination point; and placing a duct for cabling along the pathway.

21. The method of claim 20, wherein the termination point is located in a building, at a utility pole, or at another manhole.

22. The method of claim 20, wherein the positioning step comprises rotating the boring unit to a position to access the manhole.

23. The method of claim 20, wherein the positioning step comprises tilting the boring unit to a position to access the manhole.

24. The method of claim 20, wherein the positioning step comprises stabilizing the movable platform.

25. The method of claim 20, further comprising tying the hollow movable arm assembly to an attachment point within the manhole.

26. The method of claim 20, further comprising protecting the manhole.

27. The method of claim 26 wherein the protecting step comprises placing a manhole containment unit within the opening in the manhole and connecting the movable hollow arm assembly to the manhole containment unit.

28. The method of claim 26, wherein the protecting step comprises placing a manhole rim protection unit around a manhole rim and securing the manhole rim protection unit to a chimney of the manhole.

29. The method of claim 28, further comprising sealing the manhole rim protection unit to the chimney.

30. The method of claim 20, wherein the placing step comprising backpulling the duct from the termination point to the manhole.

31. The method of claim 20, further comprising sealing the opening in the manhole after the bore is complete.

32. The method of claim 20, wherein the boring step further comprises determining the horizontal and vertical depth location of a leading edge of the rods during boring.

33. The method of claim 32, wherein, in the location determining step, the leading edge of the rods is located sonically.

34. A mobile, horizontal directional boring apparatus connectable to an existing utility manhole for boring from the existing utility manhole, the apparatus comprising:

a mobile platform locatable on a ground surface adjacent the existing utility manhole; and boring machinery comprising:

a boring unit positionably supported on the mobile platform, a plurality of rods attachable end-to-end and operable under control of the boring unit to bore a pathway having a diameter and a vertical curvature and a horizontal curvature, the diameter sized to receive fiber optic cabling, and the horizontal curvature and the vertical curvature each including a curvature sufficient to extend the pathway from the existing utility manhole to a termination point, a movable hollow arm assembly mounted on the mobile platform, the arm assembly having an internal diameter sufficient to receive the plurality of rods attached end-to-end, and the arm assembly comprising:

an articulating arm having a plurality of flexible joints, a first end supported at the boring unit and located to sequentially receive the rods inserted therethrough, and a second end connectable to an opening in a wall of a manhole to direct the rods through the opening.

35. A mobile, horizontal directional boring apparatus connectable to an existing utility manhole for boring from the existing utility manhole, the apparatus comprising:

a mobile platform locatable on a ground surface adjacent the existing utility manhole; and boring machinery comprising:

a boring unit positionably supported on the mobile platform, a plurality of rods attachable end-to-end and operable under control of the boring unit to bore a pathway having a diameter and a vertical curvature and a horizontal curvature, the diameter sized to receive fiber optic cabling, and the horizontal curvature and the vertical curvature each including a curvature sufficient to extend the pathway from the existing utility manhole to a termination point, a movable hollow arm assembly mounted on the mobile platform, the arm assembly having an internal diameter sufficient to receive the plurality of rods attached end-to-end, the arm assembly comprising:

a flexible chute, a first end supported at the boring unit and located to sequentially receive the rods inserted therethrough, and a second end connectable to an opening in a wall of a manhole to direct the rods through the opening, and a stabilizer arm mounted on the platform locatable to support the flexible chute.

* * * * *

UNITED STATES PATENT AND TRADEMARK OFFICE

CERTIFICATE OF CORRECTION

PATENT NO. : 6,464,022 B1 
DATED : October 15, 2002
INVENTOR(S) : Gerard R. O'Brien et al.

It is certified that error appears in the above-identified patent and that said Letters Patent is hereby corrected as shown below:

Column 4,
Line 16, "ay" should be -- may --;

Column 7,
Line 63, "ecrewmember" should read -- crewmember --; and

Column 9,
Line 35, "rotrudable" should read -- protrudable --.

Signed and Sealed this

Fifteenth Day of April, 2003

JAMES E. ROGAN
*Director of the United States Patent and Trademark Office*